US007199761B2

(12) United States Patent
Martinez et al.

(10) Patent No.: US 7,199,761 B2
(45) Date of Patent: Apr. 3, 2007

(54) WIRELESS COMMUNICATION DEVICE WITH IMPROVED ANTENNA SYSTEM

(75) Inventors: Juan M. Martinez, Antioch, IL (US); David Fisk, Vista, CA (US); Siu Man Wong, Singapore (SG)

(73) Assignee: Motorola Inc., Schaumburg, IL (US)

( * ) Notice: Subject to any disclaimer, the term of this patent is extended or adjusted under 35 U.S.C. 154(b) by 7 days.

(21) Appl. No.: 11/200,665

(22) Filed: Aug. 10, 2005

(65) Prior Publication Data

US 2007/0035453 A1 Feb. 15, 2007

(51) Int. Cl.
*H01Q 1/24* (2006.01)

(52) U.S. Cl. ..... 343/702

(58) Field of Classification Search ..... 343/702, 343/700 MS, 846

See application file for complete search history.

(56) References Cited

U.S. PATENT DOCUMENTS 5,554,996 A 9/1996 Chatzipetros
5,995,052 A * 11/1999 Sadler et al. ..... 343/702
6,246,374 B1 6/2001 Perrotta et al.
6,285,327 B1 9/2001 See
6,300,910 B1 * 10/2001 Kim ..... 343/702
6,326,927 B1 * 12/2001 Johnson et al. ..... 343/702
6,600,450 B1 * 7/2003 Efanov et al. ..... 343/726
6,861,989 B2 3/2005 Morningstar et al.
7,038,631 B2 * 5/2006 Jecko et al. ..... 343/767
2003/0003970 A1 1/2003 Johnson et al.
2003/0032443 A1 2/2003 Johnson et al.

FOREIGN PATENT DOCUMENTS

EP 1 271 793 A2 1/2003
EP 1 271 793 A3 11/2003

* cited by examiner

*Primary Examiner*—Hoang V. Nguyen
(74) *Attorney, Agent, or Firm*—Randi L. Karpinia; Sylvia Chen; Douglas S. Rupert

(57) ABSTRACT

A wireless communication device (100) comprises an antenna (204) comprising a major radiating element (210) that includes a letter C shaped part (212) connected to a letter U shaped part (214). The major radiating element (210) is spaced from a ground plane (302) and one or more components (206, 208) having conductive parts are located between the major radiating element (210) and the ground plane (302). Openings (314, 316) in the ground plane (302) are located under the components (206, 208) or terminals (310) of the components (206, 208). Passive radiators (126, 700) having multiple sections (602, 604, 702, 704, 706) of different transverse dimension are located on a flip (110) of the wireless communication device (100) proximate the antenna (204).

11 Claims, 5 Drawing Sheets

WIRELESS COMMUNICATION DEVICE WITH IMPROVED ANTENNA SYSTEM

FIELD OF THE INVENTION

The present invention relates generally to wireless communication. More specifically the present invention relates to compact wireless mobile units.

BACKGROUND

Cellular telephony has revolutionized personal communications. People are now able to enjoy ready access to voice and data networks. The continued phenomenal progress of electronics has encouraged development of smaller handheld wireless communication devices ("mobile units") with increased functionality, e.g., music, video, and tactile simulation of base audio. Certain components of mobile units, such as antennas, displays, multifunction transducers, and hinge mechanisms do not continually scale down in size and consequently become limiting factors in efforts to maintain or reduce the size of mobile units while at the same time increase or maintain functionality. In as much as the wireless communication signals have a wavelength that is comparable to the size of mobile units, the antennas of the mobile units are very subject to disturbance by parts of the mobile units themselves. Given the trends toward higher functionality and smaller size mobile units, it is often necessary to place other internal parts of the mobile units close to the antenna. Placing other internal parts close to the antenna often leads to degraded antenna performance. It would be desirable to be able to provide an antenna system that performs well notwithstanding the close proximity of other parts of the mobile units.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
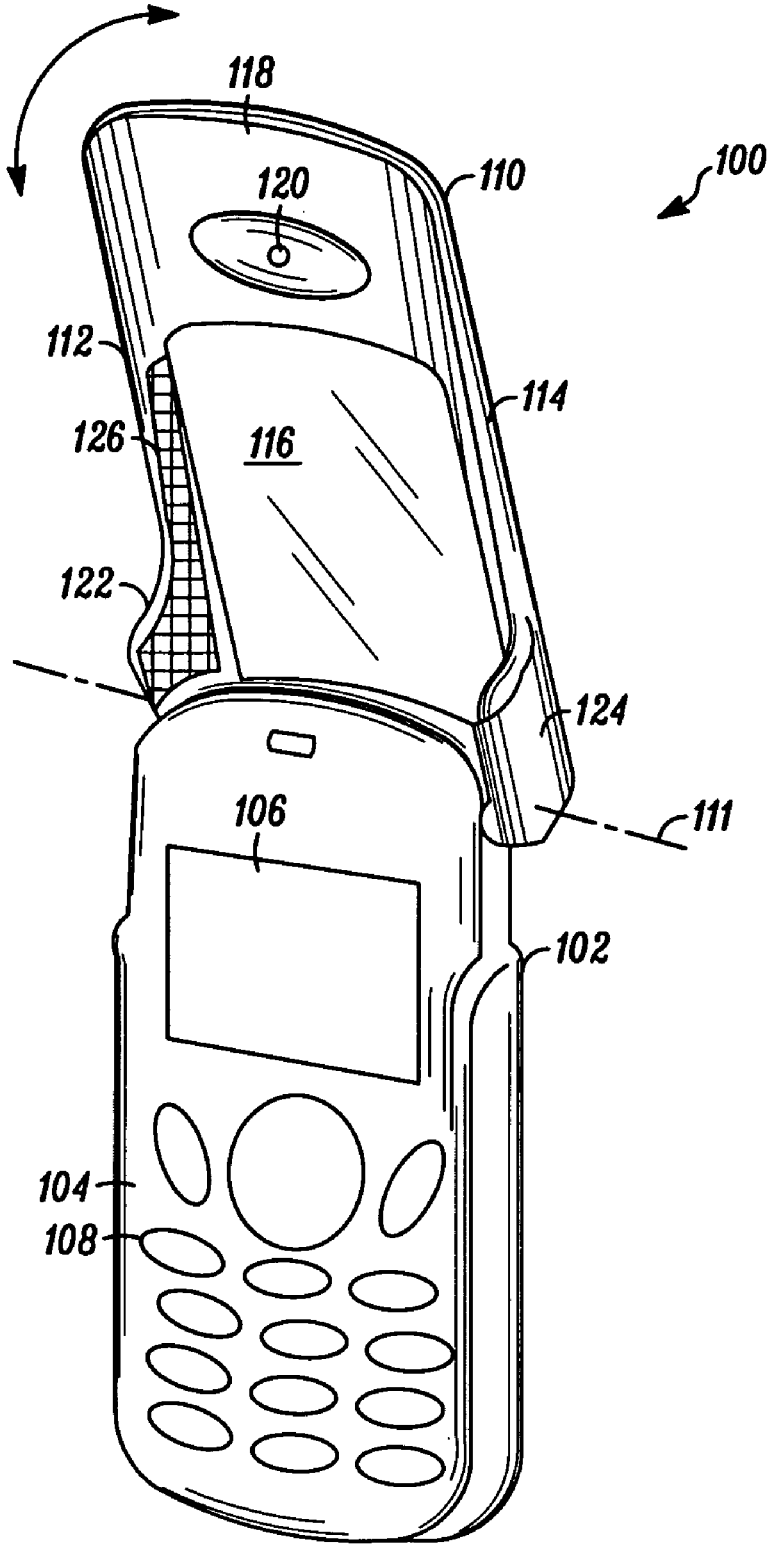
FIG. 1 is a perspective view of an example of a wireless communication device in accordance with some embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations and apparatus components related to wireless communication devices. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 is a perspective view of an example of a wireless communication device 100 in accordance with some embodiments of the invention. The device 100 has a housing 102, that has a front panel 104. The front panel 104 includes a display 106 and a keypad 108.

Figure 8:
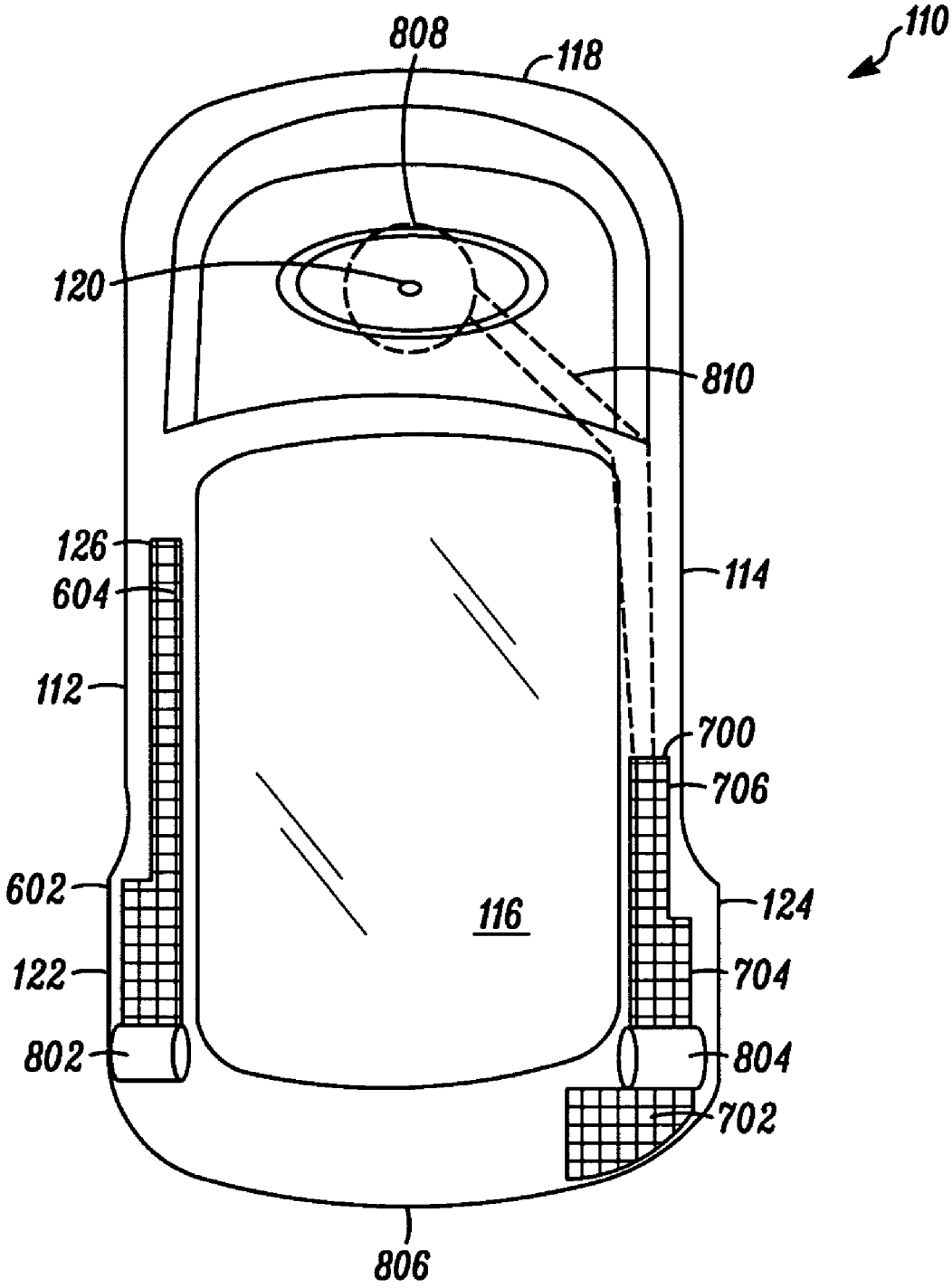
FIG. 8 is a front view of a flip of the wireless communication device shown in FIG. 1 including the high band passive radiator shown in FIG. 6 and the low band passive radiator shown in FIG. 7.

A flip 110 is pivotably coupled to the housing 102 using, a hinge detent mechanism 208 (FIGS. 2–3) and a pair of trunnions 802, 804 (FIG. 8). The flip 110 pivots about a virtual axis 111. The flip 110 includes a first longitudinally extending side portion 112 and a second longitudinally extending side portion 114 which are disposed on either side of a window 116. The display 106 is visible through the window 116 when the flip 110 is in a closed position overlying the display 106. The longitudinally extending side portions 112, 114 connect to a top portion 118 that is disposed on top of the window 116, and a bottom portion 806 (FIG. 8) that is not visible in FIG. 1). An earpiece speaker 808 (FIG. 8) is ported through an opening 120 in the top portion 118. A first wing member 122 and a second wing member 124 extend perpendicularly away from a plane of the flip 110. The first wing member 122 is connected to the first longitudinally extending side portion 112 and the second wing member 124 is connected to the second longitudinally extending side portion 114. The flip 110 is pivotably coupled to the housing 102 via the first wing member 122 and second wing member 124.

Figure 6:
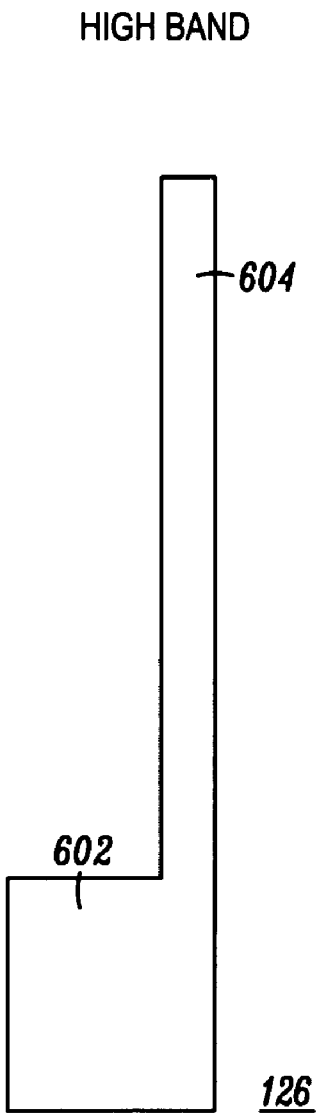
FIG. 6 is a plan view of a high band passive radiator that works in conjunction with the antenna of the wireless communication device that is shown in FIGS. 2–4.

A first passive radiating element 126 that is described further below with reference to FIGS. 6, 8 is disposed on the first longitudinally extending side portion 112 and the first wing member 122. The first passive radiating element, which suitably takes the form of a conductive coating is shown as a cross-hatched area in FIG. 1.

Figure 2:
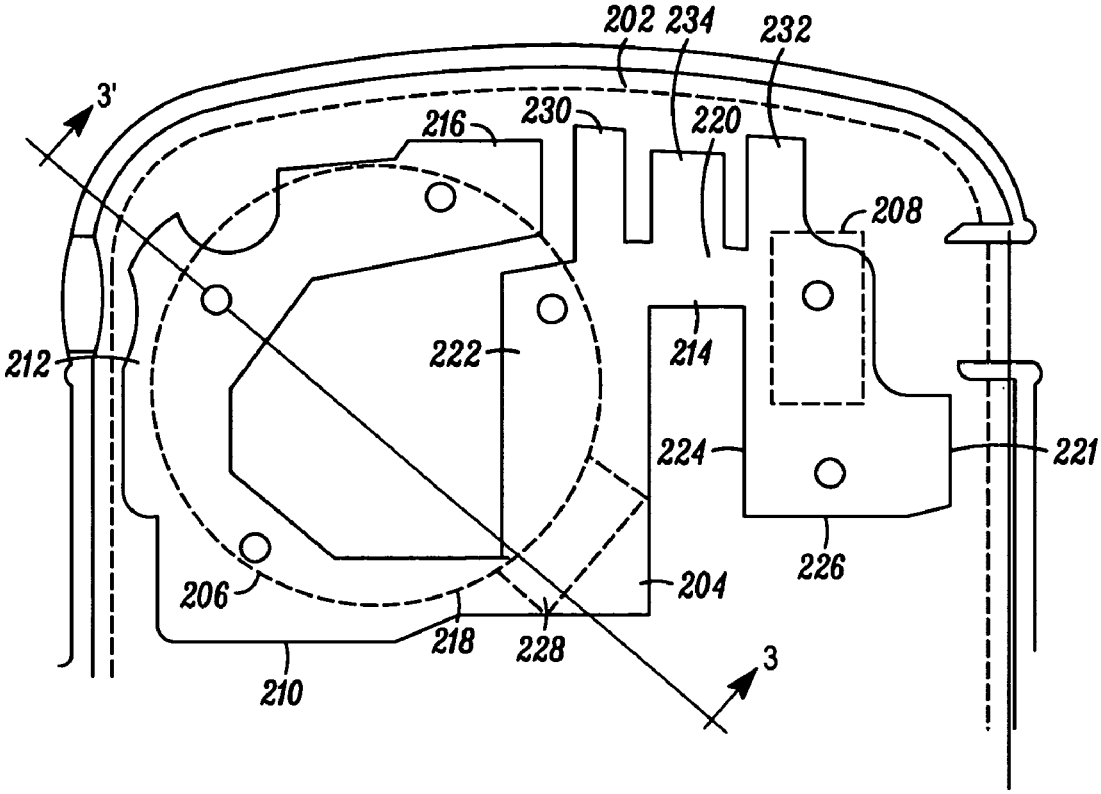
FIG. 2 is a fragmentary x-ray, view inside a housing of the wireless communication device shown in FIG. 1, showing a printed circuit board, an antenna, a multi-function transducer and a hinge.
Figure 3:
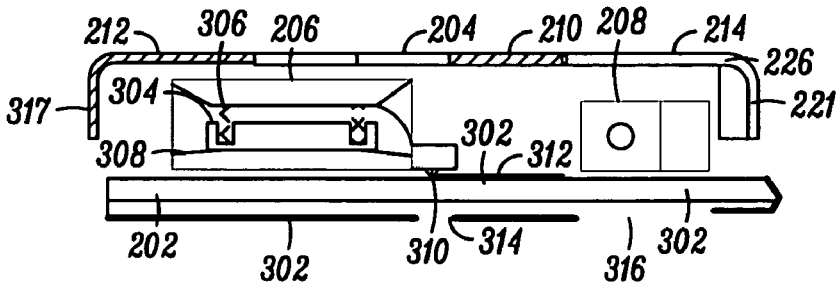
FIG. 3 is a sectional view through the portion of the wireless communication device shown in FIG. 2.
Figure 4:
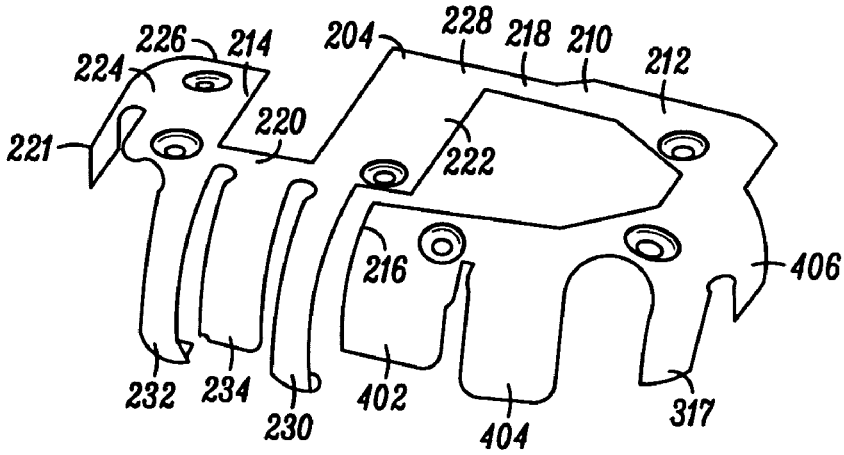
FIG. 4 is a perspective view of the antenna shown in FIGS. 2–3.
Figure 5:
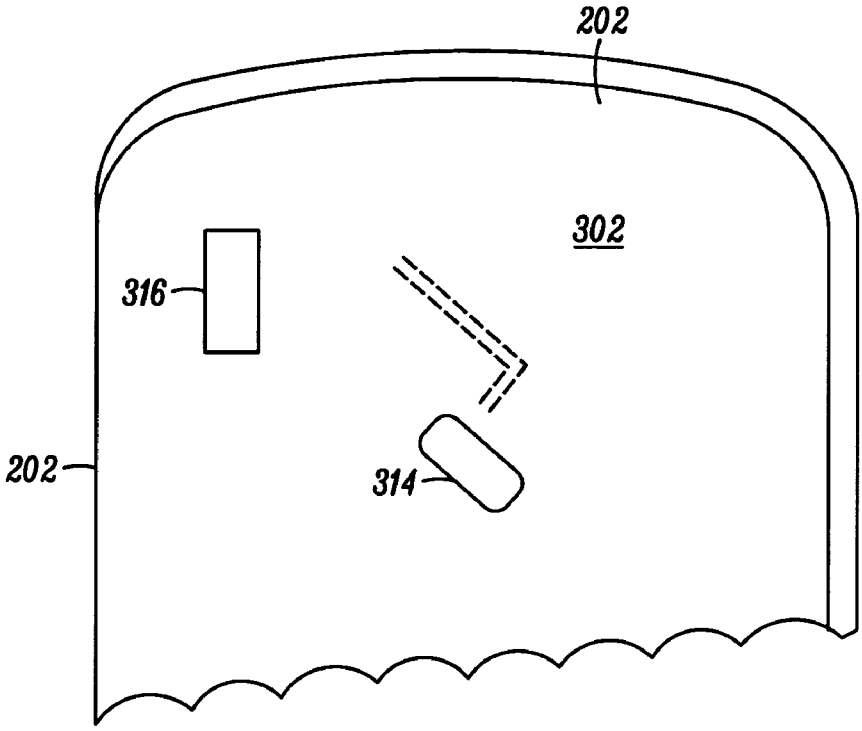
FIG. 5 is a bottom view of the printed circuit board of the wireless communication device that is shown in FIGS. 2–3.

FIG. 2 is a fragmentary x-ray view inside the housing 102 of the wireless communication device 100 shown in FIG. 1, showing a printed circuit board 202, an antenna 204, a multi-function transducer (MFT) 206 and a hinge detent mechanism 208, FIG. 3 is a sectional view through the portion of the wireless communication device 100 shown in FIG. 2, FIG. 4 is a perspective view of the antenna 204 shown in FIGS. 2–3 and FIG. 5 is a bottom view of the printed circuit board 202 of the wireless communication device that is shown in FIGS. 2–3. The antenna 204 has a major radiating element 210 that includes a letter C shaped part 212 and an inverted letter U shaped part 214. The letter C shaped part 212 includes a first free end 216 and a second end 218. The MFT 206 is centered in the open space of the letter C shaped part 212. The latter arrangement is believed to reduce unwanted parasitic interaction between the antenna 204 and the MFT 206. The inverted letter U shaped part 214 includes first, base segment 220, a second segment 222 that depends from the base segment 220, and a third segment 224 that depends from the base segment 220 opposite from the second segment 222. The third segment 224 extends from the base segment 220 to a second free end 226 of the major radiating element 210. The second segment 222 extends from the base segment 220 to a fourth end 228 at which the second segment 222 joins the second end 218 of the letter C shaped part 212.

A first tuning tab 221 extends from the third segment 224 of the letter U shaped part 214 proximate 226 toward the printed circuit board 202 (into the plane of the drawing sheet). A second tuning tab 402, a third tuning tab 404, a fourth tuning tab 317 and a fifth tuning tab 406 extend toward the printed circuit board and are arranged in sequence starting at the first free end 216 of the letter C shaped part 212. The tuning tabs 221, 402, 404, 317, 406 serve to effectively increase electrical lengths of the letter C shaped part 212 and the letter U shaped part 214 and lower operating frequencies to desired values for a high band (e.g., 1900 MHz) and a low frequency band (e.g., 850 MHz) of the antenna 204.

A signal feed conductor 230 and a grounding conductor 232 attach to the base segment 220. The signal feed conductor 230 and the grounding conductor 232 bend toward the printed circuit board 202. A dual frequency transceiver (not shown) is connected to the signal feed conductor 230. A ground plane 302 of the printed circuit board 202 is coupled to the grounding conductor 232. As such the ground plane 302 serves as a counterpoise for the antenna 204. An impedance match tuning tab 234 is disposed between the signal feed conductor 232 and the grounding conductor 232. Note that the antenna 204 is a variant of a type of antenna termed a Planar Inverted F Antenna (PIFA). The antenna 204 is also a dual band antenna. The letter U shaped part 214 of the antenna 204 is most strongly associated with operation in the high frequency band (e.g., 1900 MHz) and the letter C shaped part 212 of the antenna 204 is more strongly associated with operation in the low frequency band (e.g., 850 MHz).

The MFT 206 produces audio and vibrations in response to input electrical signals. The MFT 206 includes certain electrically conductive parts including a magnet-yoke assembly 304, a solenoid 306, and a spiral arm leaf spring 308. The MFT 206 also has electrical terminals 310 (one shown) for inputting electrical signals for driving the MFT 206. Within the MFT 206, the electrical terminals 310 are coupled to the solenoid 306. Externally, the electrical terminals 310 of the MFT 206 are connected to a pattern of printed wiring 312 of the printed circuit board 202. A first opening 314 in the ground plane 302 is aligned with the electrical terminals 310. It has been found that providing the first opening 314 reduces an undesirable parasitic interaction of the conductive parts 304, 306, 308 of the MFT 206 and the antenna 204, and improves the radiative efficiency of the antenna 204. The hinge detent mechanism 208 is also made of electrically conductive metal. A second opening 316 in the ground plane 302 is provided underneath the hinge detent mechanism 208 in the interest of further improving the radiative efficiency of the antenna 204. Note that the ground plane 302 may comprises multiple layers of the printed circuit board 202.

FIG. 6 is a plan view of the first passive radiator 126. The first passive radiator 126 which works in conjunction with the antenna 204 of the wireless communication device 100 to enhance antenna efficiency in a high frequency band (e.g., at 1900 MHz). The first passive radiator 126 is divided longitudinally into a lower section 602 and an upper section 604. Note that the upper section 602 and lower section 604 have different transverse dimensions and are not traversely centered with each other. The wider lower section 602 is located on the first wing member 122 of the flip 110. The narrower upper section 604 locates along side the window 116 on the first longitudinally extending side portion 112 of the flip 110.

Figure 7:
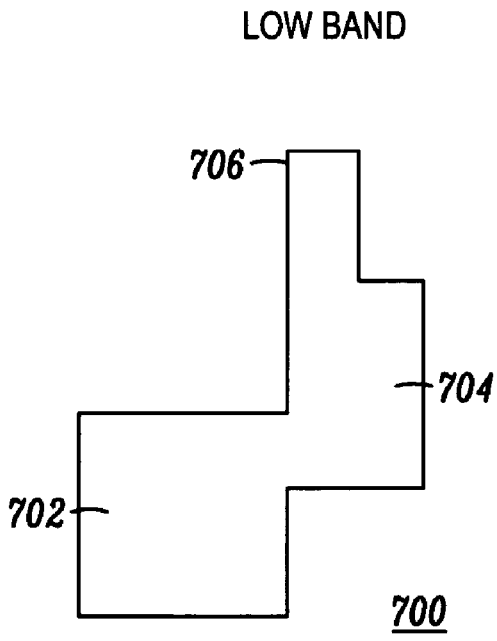
FIG. 7 is a plan view of a low band passive radiator that works in conjunction with the antenna of the wireless communication device that is shown in FIGS. 2–4.

FIG. 7 is a plan view of a second passive radiator 700. The second passive radiator 700 works in conjunction with the antenna 204 to enhance antenna efficiency in a low frequency band (e.g., 850 MHz). The second passive radiator 700 has a lower section 702, a middle section 704 and an upper section 706. The three parts 702, 704, 706 of the second passive radiator 700 have different widths and are not transversly centered with respect to each other. The lower section 702 is wider than the middle section 704 and the middle section 704 is wider than the upper section 706.

FIG. 8 is a front view of the flip 110 of the wireless communication device 100 shown in FIG. 1 including the high band passive radiator 126 shown in FIGS. 1, 6 and the low band passive radiator 700 shown in FIG. 7. As seen, in FIG. 8 the bottom portion 806 of the flip 110 is attached to the longitudinally extending side portions 112, 114 and the wing members 122, 124. The lower section 702 of the second passive radiator 700 locates on the bottom portion 806 of the flip 110. The middle section 704 of the second radiator is located on the second wing member 124 and the top upper section 706 is located on the second longitudinally extending side portion 114. As shown in FIG. 8 the lower section 702 of the second passive radiator 700 is trimmed to conform to the curved shape of the bottom portion 806 of flip 110. A ribbon cable 810 is routed through the second longitudinally extending side portion 114 of the flip 110 to the earpiece speaker 808 located in the top portion 118 of the flip 110. The ribbon cable 810 works in conjunction with the second passive radiator 126 to enhance the radiative efficiency of the antenna 204. Although in the open position (as shown in FIG. 1) the flip 110 is somewhat inclined relative to the housing 102 of the device 100, and it is inclined relative to a plane of the major radiating element 210 that includes a longitudinal axis of the third segment 224 of the letter U shaped portion 214 of the major radiating element 210, a projection of a longitudinal axis of the first passive radiating element 126 onto the aforementioned plane is substantially parallel to the longitudinal axis of the third segment 224. Consequently improved coupling between the antenna 204 and the first passive radiating element 210 is obtained. When the flip 110 is closed the longitudinal axis of the third segment 224 is aligned parallel to the axis of the first passive radiating element 126, such that enhanced coupling is again obtained.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A wireless communication device comprising:

a printed circuit substrate comprising a pattern of printed wiring and a ground plane;

an antenna having a major radiating element arranged in spaced relation to said printed circuit substrate wherein said ground plane serves as a counterpoise of said antenna;

an electrical component disposed between said printed circuit substrate and said major radiating element of said antenna, said electrical component comprising an electrical terminal coupled to said pattern of printed wiring; and wherein said ground plane comprises an opening aligned with said electrical terminal of said electrical component, whereby parasitic interaction between said antenna and said electrical component is reduced.

2. A wireless communication device comprising:

a printed circuit substrate comprising a ground plane;

an antenna having a major radiating element arranged in spaced relation to said printed circuit substrate, wherein said ground plane serves as a counterpoise of said antenna;

a conductive component disposed between said printed circuit substrate and said major radiating element of said antenna; and wherein said ground plane comprises an opening aligned with said conductive component, whereby parasitic interaction between said antenna and said conductive component is reduced.

3. A wireless communication device comprising:

printed circuit board comprising a ground plane;

a dual-frequency antenna comprising a major radiating element that is spaced from said ground plane a follows and convoluted path that substantially parallels said ground plane, said major radiating element comprising a letter C shaped part, and an inverted letter U shaped part, said letter C shaped part comprising a first, free end and a second end, said inverted letter U shaped part comprising a first base segment, a second segment extending from said base segment to a third, free end, and a third segment extending from said base segment to a fourth end that is connected to and contiguous with said second end of said letter C shaped part.

4. The wireless communication device according to claim 3 further comprising:

a component that is least partially conductive disposed in alignment with an open space within said letter C shaped part of said major radiating element between said major radiating element and said ground plane.

5. The wireless communication device according to claim 4 wherein said component comprises a multi function transducer that is capable converting electrical signals to vibrations and sounds.

6. The wireless communication device according to claim 4 further comprising:

a housing, wherein said printed circuit board, said dual frequency antenna, and said conductive component are housed in said housing;

a flip that is hingedly coupled to said housing;

an elongated passive radiating element disposed on said flip, wherein a projection of said elongated passive radiating element onto a plane that substantially includes said major radiating element is aligned substantially parallel to said second segment of said letter U-shaped part of said major radiating element, whereby radiation from said letter U-shaped part is substantially enhanced by said elongated passive radiating element.

7. The wireless communication device according to claim 6 wherein said passive radiating element comprises successive sections of stepped transverse dimension.

8. The wireless communication device according to claim 7 wherein said successive sections are not transversely aligned.

9. The wireless communication device according to claim 3 further comprising:

a housing, wherein said printed circuit board, and said dual frequency antenna, are housed in said housing;

a flip that is hingedly coupled to said housing;

an elongated passive radiating element disposed on said flip, wherein a projection of said elongated passive radiating element onto a plane that substantially includes said major radiating element is aligned substantially parallel to said second segment of said letter U-shaped part of said major radiating element, whereby radiation from said letter U-shaped part is substantially enhanced by said elongated passive radiating element.

10. A wireless communication device comprising:

a housing;

a display disposed at a front surface of said housing;

an antenna;

a flip hingedly coupled to said housing so as to be able to pivot about an axis from a first position in which said flip overlies said display to a second position in which said flip extends away from said housing, said flip comprising an window that is framed by two longitudinally extending side portions of said flip, said flip further comprising two extending wing members that extend from said two longitudinally extending side portions of said flip out of a plane of said flip toward said axis;

a passive radiator for boosting efficiency of said antenna, said passive radiator comprising a first longitudinally extending portion having a first width coupled to a second portion having a second width that is greater than said first width, wherein said first longitudinally extending portion of said passive radiator is disposed on at least one of said two longitudinally extending side portions of said flip and said second portion is disposed on one of said two extending wing members.

11. The wireless communication device according to claim 10 wherein:

said flip further comprises a bottom portion that is coupled to said two longitudinally extending side portions of said flip, and to said two extending wing members of said flip; and said passive radiator further comprises a third portion coupled to said second portion, wherein said third portion has a third width that exceeds said second width, and said third portion of said passive radiator is disposed on said bottom portion of said flip.

* * * * *